US012146376B2

(12) United States Patent
Sneed et al.

(10) Patent No.: US 12,146,376 B2
(45) Date of Patent: Nov. 19, 2024

(54) TUBING HANGER RUNNING TOOL ASSEMBLY

(71) Applicant: INNOVEX DOWNHOLE SOLUTIONS, INC., Houston, TX (US)

(72) Inventors: Brian Sneed, Houston, TX (US); Mark McGilvray, Jr., Houston, TX (US); Mina Hanna, Houston, TX (US); Eric Calzoncinth, Houston, TX (US)

(73) Assignee: INNOVEX DOWNHOLE SOLUTIONS, INC., Houston, TX (US)

( * ) Notice: Subject to any disclaimer, the term of this patent is extended or adjusted under 35 U.S.C. 154(b) by 112 days.

(21) Appl. No.: 18/048,518

(22) Filed: Oct. 21, 2022

(65) Prior Publication Data

US 2023/0127716 A1 Apr. 27, 2023

Related U.S. Application Data

(60) Provisional application No. 63/270,923, filed on Oct. 22, 2021.

(51) Int. Cl.
*E21B 33/04* (2006.01)
*E21B 23/03* (2006.01)

(52) U.S. Cl.
CPC ..... *E21B 33/04* (2013.01); *E21B 23/03* (2013.01); *E21B 33/0407* (2013.01)

(58) Field of Classification Search
CPC ..... E21B 33/03; E21B 23/00; E21B 33/0407
See application file for complete search history.

(56) References Cited

U.S. PATENT DOCUMENTS

| | | | |
|---|---|---|---|
| 6,516,875 | B2 | 2/2003 | Reilly et al. |
| 10,392,883 | B2 | 8/2019 | Thornburrow et al. |
| 2016/0145960 | A1 | 5/2016 | Gadre et al. |
| 2018/0258726 | A1 | 9/2018 | Evert, Jr. et al. |
| 2018/0258727 | A1 | 9/2018 | Lim et al. |

FOREIGN PATENT DOCUMENTS

| | | | |
|---|---|---|---|
| WO | 2020139944 | A1 | 7/2020 |

OTHER PUBLICATIONS

International Search Report and Written Opinion dated Feb. 15, 2023, PCT Application No. PCT/US2022/078486, 11 pages.
International Preliminary Report on Patentability dated May 2, 2024, PCT Application No. PCT/US2022/078486, 7 pages.

*Primary Examiner* — Young-Suk (Philip) Ro
(74) *Attorney, Agent, or Firm* — MH2 Technology Law Group, LLP

(57) ABSTRACT

A tubing hanger running tool assembly includes a ring extending around a tubing hanger in a wellhead, and having a contracted configuration and an expanded configuration. The ring in the expanded configuration is received into a groove in the wellhead. The assembly includes a sleeve to actuate the ring between the contracted and expanded configurations. The sleeve includes a tubing hanger running tool received through the sleeve and having a lower end that is configured to be received into a first bore of the tubing hanger and to form a connection therewith. The tubing hanger running tool is configured to transmit an axial force to the sleeve in response to the tubing hanger running tool being received into the tubing hanger. The axial force moves the sleeve axially with respect to the ring, which actuates the ring between the contracted and expanded configurations.

27 Claims, 7 Drawing Sheets

TUBING HANGER RUNNING TOOL ASSEMBLY

CROSS-REFERENCE TO RELATED APPLICATIONS

This application claims priority to U.S. Provisional Patent Application having Ser. No. 63/270,923, which was filed on Oct. 22, 2021 and is incorporated herein by reference in its entirety.

BACKGROUND

Wellhead assemblies are positioned at a top of a well and generally include one or more devices that control fluid flow into and out of the well. For example, wellhead assemblies may include a blowout preventer, positioned on a wellhead, with an adapter therebetween. A tubing hanger may be disposed in the wellhead and landed on a shoulder or another load surface therein. Production tubing, through which fluid recovered from the well, may be coupled to the tubing hanger and suspended therefrom into the well.

Safety regulations may require that the wellhead assemblies be capable of withstanding a high amount of transient upward pressure differentials, e.g., high pressure within the well, below the wellhead in comparison to the pressure above the wellhead. In particular, the tubing hanger may be secured against upward displacement relative to the wellhead using a lockdown device.

SUMMARY

Embodiments of the disclosure include a tubing hanger running tool assembly, which includes a ring that is configured to extend around a tubing hanger in a wellhead, the ring having a contracted configuration and an expanded configuration, the ring in the expanded configuration being configured to be received into at least one groove in the wellhead, a sleeve configured to selectively engage the ring so as to actuate the ring between the contracted and expanded configuration, and a tubing hanger running tool received through the sleeve and including a lower end that is configured to be received into a first bore of the tubing hanger, the lower end being configured to form a connection with the first bore of the tubing hanger. The tubing hanger running tool is configured to transmit an axial force to the sleeve in response to the tubing hanger running tool being received into the tubing hanger, the axial force moving the sleeve axially with respect to the ring, and moving the sleeve axially relative to the ring actuating the ring between the contracted and expanded configurations.

Embodiments of the disclosure also include a system including a wellhead defining a central bore therein and a groove extending at least partially around the bore, a tubing hanger received into the central bore of the wellhead, the tubing hanger defining a first bore and a second bore extending therethrough, the first bore for being connected to a production tubing, a ring positioned around the tubing hanger and having a contracted configuration in which the ring does not prevent the tubing hanger from moving relative to the wellhead, and an expanded configuration in which the ring is received at least partially into the groove and is configured to prevent the tubing hanger from moving axially upwards with respect to the wellhead, a tubing hanger running tool received into the first bore of the tubing hanger, the tubing hanger having a threaded lower end that forms a threaded connection with the first bore, and a sleeve positioned around the tubing hanger running tool and the tubing hanger, the sleeve being axially movable by rotating the tubing hanger running tool relative to the tubing hanger, and the sleeve being configured to actuate the ring between the expanded and contracted configurations by moving axially with respect to the tubing hanger.

Embodiments of the disclosure further include a method including receiving a tubing hanger running tool into a first bore of a tubing hanger and a sleeve around the tubing hanger, the tubing hanger having a second bore, the first and second bores being eccentrically positioned in the tubing hanger, and actuating a ring positioned around the tubing hanger into an expanded configuration in which the ring engages a wellhead in which the tubing hanger is positioned. Actuating the ring comprises moving the tubing hanger running tool relative to the tubing hanger and the sleeve, moving the tubing hanger running tool transmits an axial force to the sleeve, the sleeve moves axially relative to the ring so as to actuate the ring, and the ring in the expanded configuration prevents the tubing hanger from being displaced vertically upward in a wellhead. The method further includes withdrawing the tubing hanger running tool and at least a portion of the sleeve from engagement with the tubing hanger while the ring remains in the expanded configuration.

BRIEF DESCRIPTION OF THE DRAWINGS

The present disclosure may best be understood by referring to the following description and accompanying drawings that are used to illustrate embodiments of the invention. In the drawings.

DETAILED DESCRIPTION

Figure 1A:
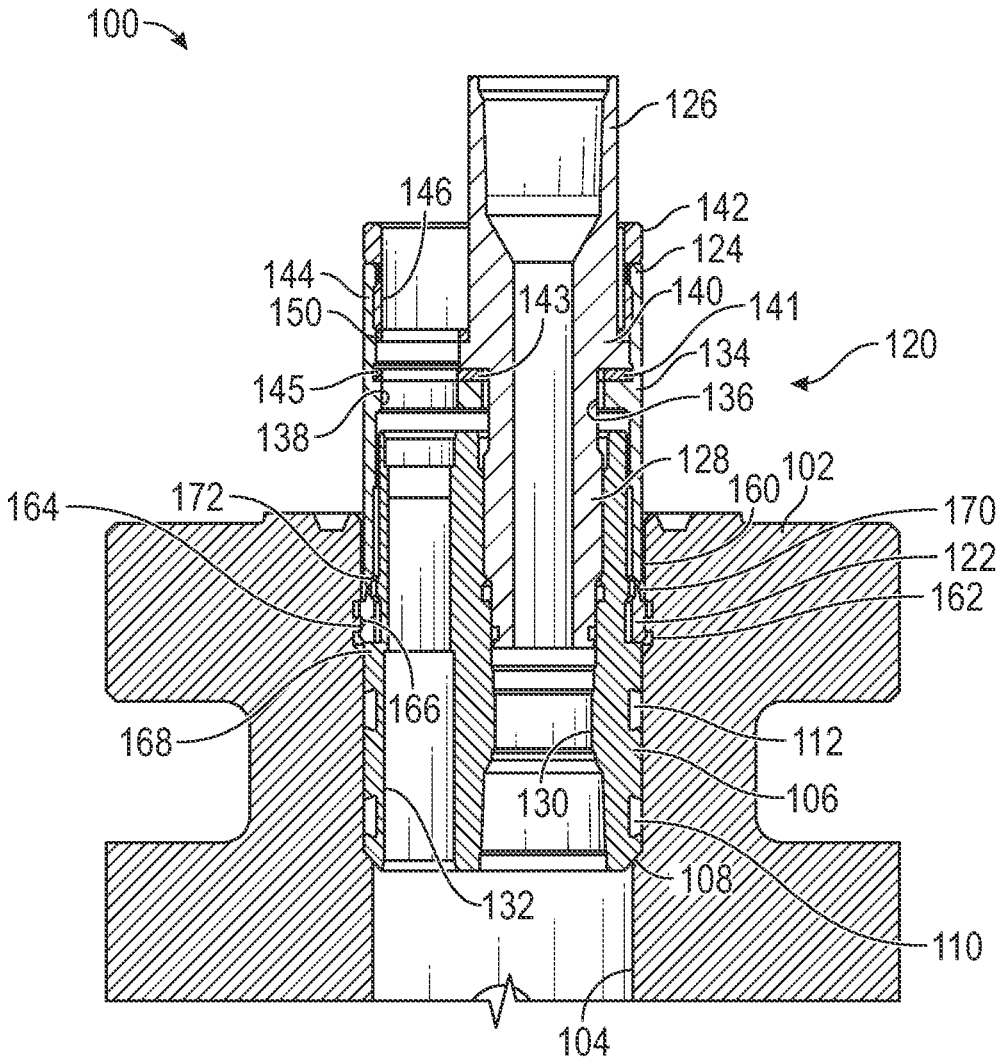
FIG. 1A illustrates a side, cross-sectional view of a wellhead assembly, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

FIG. 1A illustrates a side, cross-sectional view of a wellhead assembly 100, according to an embodiment. The wellhead assembly 100 generally includes a wellhead 102 that defines a central bore 104 therethrough, permitting access to an interior of a well extending below. A tubing hanger 106 may be received into the central bore 104, and, e.g., landed on a load surface 108 defined within the central bore 104. The tubing hanger 106 may include one or more seals (two shown: 110, 112) that seal with the central bore 104.

Figure 1B:
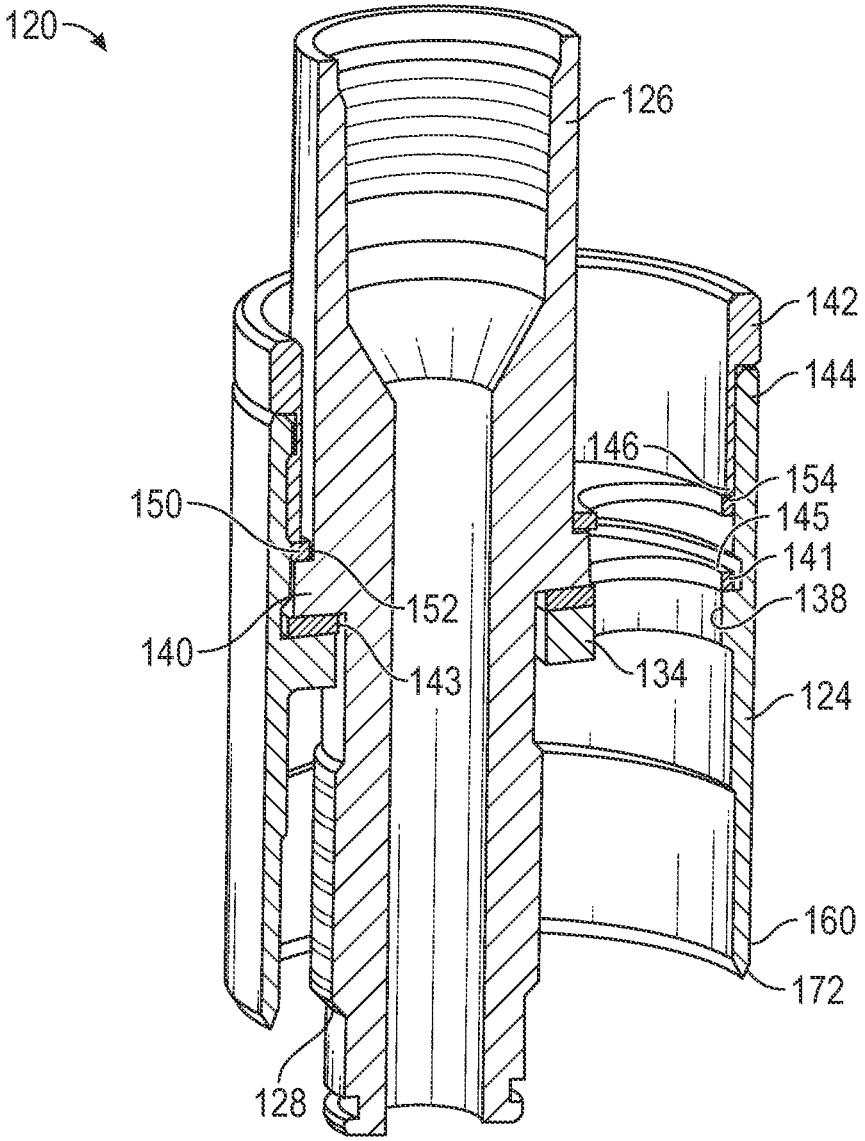
FIG. 1B illustrates a perspective view of a section of a tubing hanger running tool assembly, according to an embodiment.

The wellhead assembly 100 may also include a tubing hanger running tool assembly 120. FIG. 1B illustrates a perspective view of a section of the tubing hanger running tool assembly 120, according to an embodiment. Referring to both FIGS. 1A and 1B, the tubing hanger running tool assembly 120 may be configured to prevent an upward pressure differential (i.e., higher pressure in well below the tubing hanger 106 than above the tubing hanger 106) from displacing the tubing hanger 106 from its position in the central bore 104, with the seals 110, 112 effectively sealing with the central bore 104. At least a part of the tubing hanger running tool assembly 120 may be removable from engagement with the tubing hanger 106, without removing the tubing hanger 106 from within the central bore 104, thereby permitting the tubing hanger 106 to function normally to transfer the load of the production tubing extending therefrom to the wellhead 102, as will be described in greater detail below.

In an embodiment, the tubing hanger running tool assembly 120 may include a ring 122, a sleeve 124 (e.g., an "energizing" or "actuation" sleeve), and a tubing hanger running tool 126. The tubing hanger running tool 126 may be received through the sleeve 124 and may include a lower end 128 that is threaded into engagement with threads formed in a first bore 130 of the tubing hanger 106. The tubing hanger 106 may also include a second bore 132, which may be configured to receive a secondary communication line (e.g., a wellhead electrical penetrator, as will be discussed below). In other embodiments, the second bore 132 may be configured as a second production bore. The tubing hanger 106 may include three or more such bores. The tubing hanger running tool 126 may not be received through the second bore 132. Further, as can be seen in the figure, the first and second bores 130, 132 are eccentrically positioned within the tubing hanger 106, that is, neither of the centerlines of the first and second bores 130, 132 are coaxial with the centerline of the tubing hanger 106 and/or the central bore 104.

The sleeve 124 may include a bearing plate 134, which may be cast, machined, or otherwise formed as an integral part of the rest of the sleeve 124, or may be a separate component attached therein. The bearing plate 134 may include a first bore 136 and a second bore 138, which may align with the first and second bores 130, 132 of the tubing hanger 106. The tubing hanger running tool 126 may be received through the first bore 136 of the bearing plate 134. Further, the tubing hanger running tool 126 may include a radially-extending shoulder 140 which may apply an axially downward force to the bearing plate 134, and thus the sleeve 124, e.g., by rotating the tubing hanger running tool 126 in a first direction relative to the tubing hanger 106 so as to advance the tubing hanger running tool 126 into the first bore 130 of the tubing hanger 106.

A lower bearing insert 141 may be provided between the bearing plate 134 and the shoulder 140 and may serve as a plain bearing that permits rotating of the tubing hanger running tool 126 relative to the sleeve 124, while the shoulder 140 applies axial force to the sleeve 124 via the bearing plate 134. In other embodiments, other types of axial thrust bearings may be used instead of a plain bearing, e.g., the bearing plate 134 could include rollers. Thus, the lower bearing insert 141 may define first and second bores 143, 145 that are aligned with the first and second bores 136, 138, with the tubing hanger running tool 126 being received through the first bore 143.

The assembly 120 may also include an upper collar 142 which may be threaded into or otherwise attached to an upper end 144 of the sleeve 124. The upper collar 142 may have a lower end 146 that is disposed proximal to the bearing plate 134 when the upper collar 142 is connected to the upper end 144 of the sleeve 124. An upper bearing insert 150 may be entrained between the lower end 146 of the upper collar 142. The upper bearing insert 150 may include first and second bores 152, 154, which are aligned with the first and second bores 136, 138 of the bearing plate 134. Accordingly, rotating the tubing hanger running tool 126 in a second direction that withdraws the tubing hanger running tool 126 from within the first bore 130 of the tubing hanger 106 may cause the tubing hanger running tool 126 to apply an upward axial force to the sleeve 124 via engagement between the shoulder 140, the upper bearing insert 150, and the upper collar 142. The sleeve 124 may thus be caused to move axially upward with respect to the tubing hanger 106 by such force.

The sleeve 124 also includes a lower end 160, which may be axially separated from the bearing plate 134 such that the lower end 160 is able to engage the ring 122, as will be described in greater detail below, before the bearing plate 134 interferes with the upper end of the tubing hanger 106. The lower end 160 may be configured to engage the ring 122 and either drive the ring 122 radially outwards or press the ring 122 radially inwards, e.g., depending on the bias of the ring 122. For example, the ring 122 may have a contracted configuration, in which the ring 122 has a smaller outer diameter than the inner diameter of the central bore 104. This may, for example, permit installation of the ring 122 around the tubing hanger 106 in the bore 104. Alternatively, the ring 122 may be pre-installed on the tubing hanger 106 and then installed into the central bore 104 along with the tubing hanger 106 while the ring 122 is in the contracted configuration.

The ring 122 may also have an expanded configuration, in which the outer diameter thereof is larger than the nominal inner diameter of the central bore 104. The central bore 104 may be provided with a groove 162 extending radially outward for receiving the ring 122 in the expanded configuration. In an embodiment, the groove 162 may include a central ledge (or another type of protrusion) 164, which may be received into a central recess 166 of the ring 122. In an embodiment, the ring 122 may be a split ring, e.g., a snap ring, or may be a segmented ring.

A lower axial side of the ring 122 may also engage a shoulder 168 of the tubing hanger 106, at least in the expanded configuration. The ring 122 in the expanded configuration, received into the groove 162 may thus resist vertical displacement. Accordingly, the ring 122 engaging the shoulder 168 and received into the groove 162 may thus prevent the vertically upward movement of the tubing hanger 106 in the central bore 104.

In the illustrated embodiment, the ring 122 is biased toward the expanded configuration. Accordingly, the ring 122 may be forced into its contracted configuration by the lower end 160 of the sleeve 124. For example, the upper axial side of the ring 122 may include a taper 170, and the lower end 160 of the sleeve 124 may include a complementary taper 172. Pressing the sleeve 124 axially downwards may drive the taper 172 of the sleeve 124 over the taper 170 of the ring 122, causing the ring 122 to compress radially inward. In turn, lifting the sleeve 124 axially upwards releases the ring 122 to resiliently deflect radially outwards to its expanded configuration and set the ring 122 in the bore 104.

As noted above, however, embodiments are contemplated in which the ring 122 is biased radially inwards, and thus the axial downward movement of the sleeve 124 may drive the ring 122 radially outward toward its expanded configuration. In such cases, at least a portion of the sleeve 124 (e.g., a shim) may be retained radially between the ring 122 and the tubing hanger 106.

Figure 2:
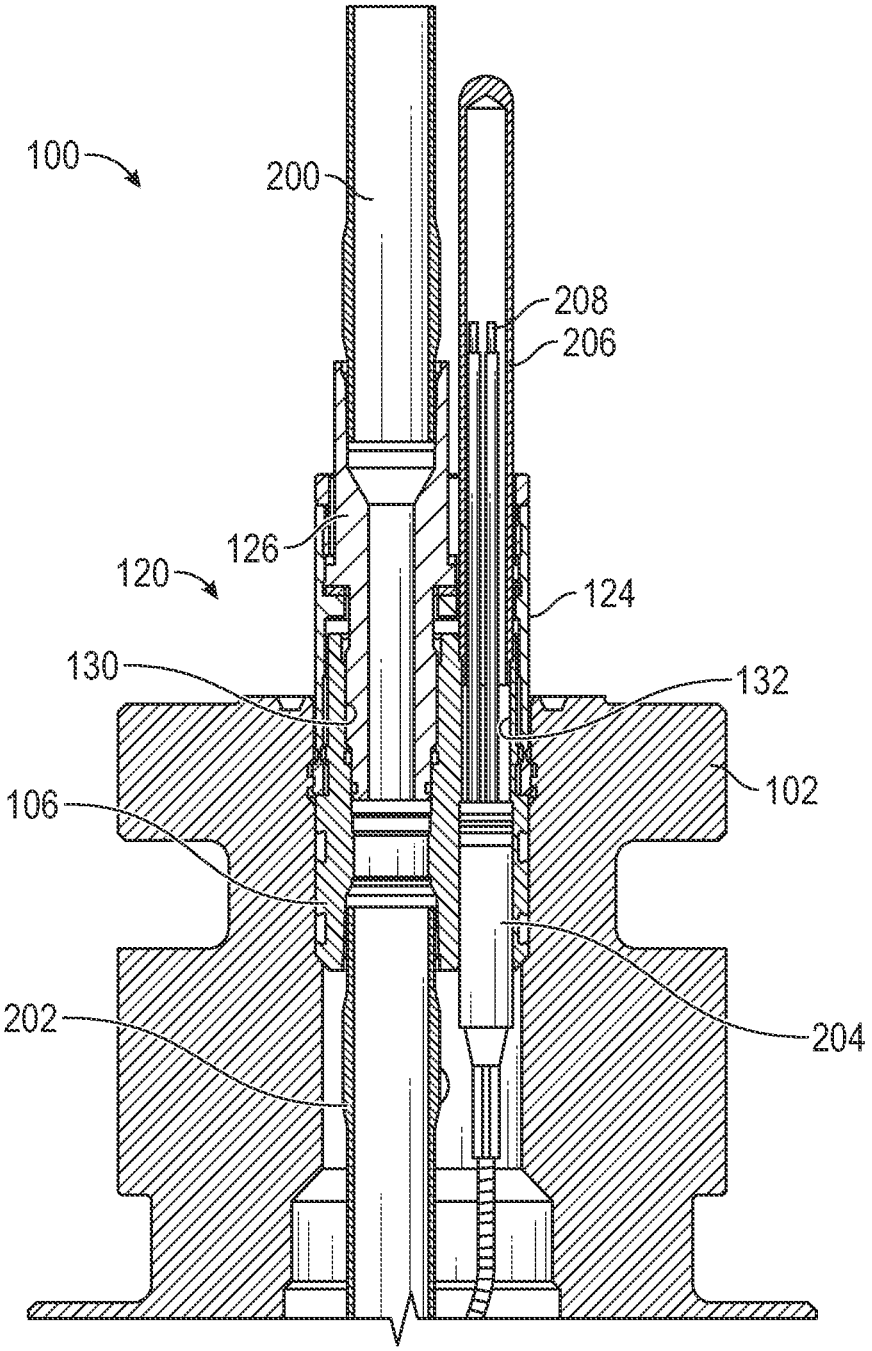
FIG. 2 illustrates another side, cross-sectional view of the wellhead assembly including the tubing hanger running tool assembly, according to an embodiment.

FIG. 2 illustrates a side, cross-sectional view of the wellhead assembly 100 including the tubing hanger running tool assembly 120, according to an embodiment. In this view, it is seen that a lifting tubular 200 is connected to the tubing hanger running tool 126. The lifting tubular 200 may be configured to lift the tubing hanger running tool 126 and the sleeve 124 into position relative to the tubing hanger 106, and to lifting the tubing hanger 106 along with the tubing hanger running tool 126 and the sleeve 124 into the wellhead 102. Further, the lifting tubular 200 may be configured to rotate the tubing hanger running tool 126 relative to the tubing hanger 106 and relative to the sleeve 124, as rotating the sleeve 124 may not be permitted. A production tubing 202 may extend from the lower end of the first bore 130 of the tubing hanger 106.

A wellhead electric penetrator 204 may be received through the second bore 132 of the tubing hanger 106. As noted above, the second bore 132 may be configured to provide another production flowpath through the wellhead 102, rather than for receiving an electric penetrator 204, in at least some embodiments. Further, the first and second bores 130, 132 are each offset from the centerline of the tubing hanger 106. Further, a cap 206 may temporarily fit over electrical leads 208 extending from the wellhead electric penetrator 204 and may be received through the sleeve 124 (e.g., through the second bore 136 of the bearing plate 134).

Figure 3:
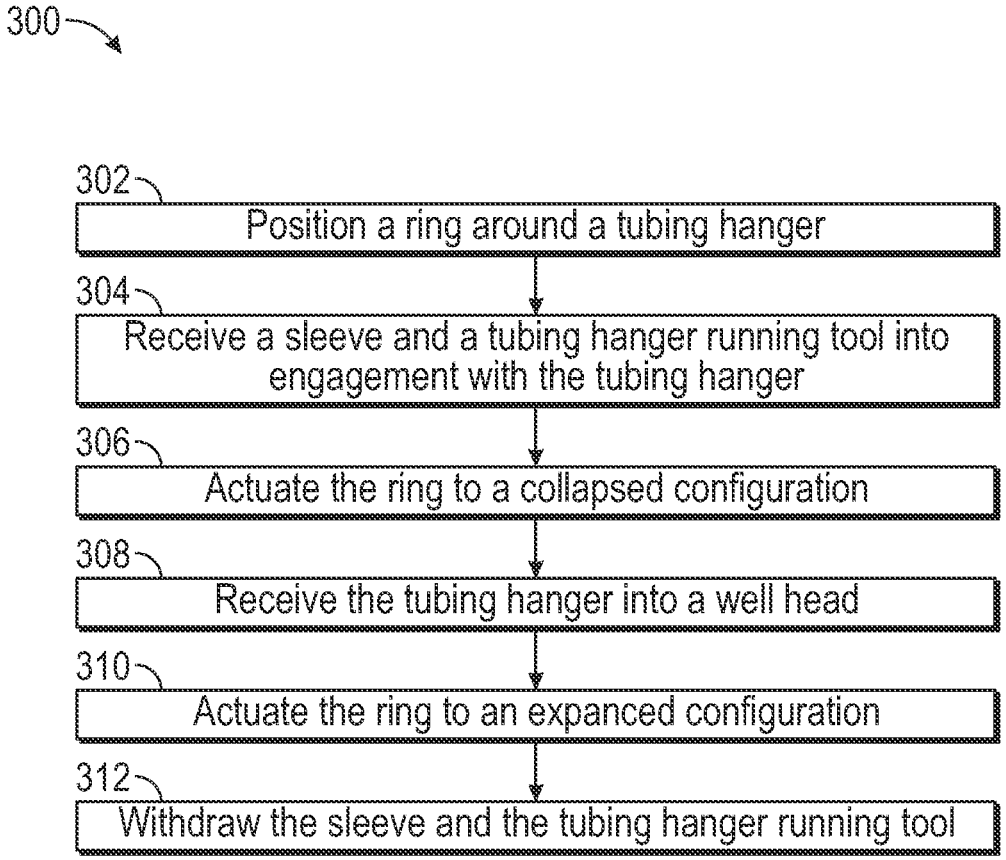
FIG. 3 illustrates a flowchart of a method for securing a tubing hanger in a wellhead, according to an embodiment.

FIG. 3 illustrates a flowchart of a method 300 for locking a tubing hanger in a wellhead, according to an embodiment. The method 300 may proceed by operation of the wellhead assembly 100, including the tubing hanger running tool assembly 120, discussed above, and thus the method 300 is described herein with reference thereto. However, other embodiments of the method 300 may use other structures. Further, the steps of the method 300 may be executed in the order described herein, or may be executed in any other order, executed in parallel, etc. Moreover, individual steps may be partitioned into two or more steps and/or any two or more steps may be combined into a single step.

The method 300 may include positioning a ring 122 around a tubing hanger 106, as at 302. For example, the ring 122 may be biased radially outward toward an expanded configuration in which the ring 122 had a larger inner diameter than the outer diameter of at least a portion of the tubing hanger 106. However, the ring 122 in the expanded configuration may engage a shoulder 168 of the tubing hanger 106.

The method 300 may then include receiving a sleeve 124 and a tubing hanger running tool 126 into engagement with the tubing hanger 106, as at 304. For example, the tubing hanger running tool 126 may be positioned through the sleeve 124, and may have a lower threaded end 128 that is received into a first bore 130 of the tubing hanger 106. Accordingly, rotating the tubing hanger running tool 126 in a first direction may advance the tubing hanger running tool 126 into the first bore 130. The sleeve 124 may be received at least partially around the tubing hanger 106. A lower end 160 of the sleeve 124 may engage the ring 122. In other embodiments, the lower end 128 may not be threaded, and the tubing hanger running tool 126 may be received linearly into the first bore 130, without rotating.

The method 300 may then include actuating the ring 122 to a collapsed configuration, as at 306. In some embodiments, the ring 122 may be biased toward the collapsed configuration, and thus this occurs simply by releasing the ring 122 around the tubing hanger 106. In other embodiments, the ring 122 may be biased toward the expanded configuration. In the latter case, actuating the ring 122 to the collapsed configuration is accomplished by rotating the tubing hanger running tool 126 in the first direction, which transmits a downward axial force to the sleeve 124 through interaction between the shoulder 140 and the bearing plate 134 (potentially via the lower bearing insert 141). This axial force drives the sleeve 124 downward, such that the taper 172 of the lower end 160 thereof is driven over the taper 170 of the ring 122, such that the lower end 160 of the sleeve 124 is received over the ring 122 and presses the ring 122 inwards to the collapsed configuration.

The method 300 may then include receiving the tubing hanger 106 into the wellhead 102, as at 308. For example, a lifting coupling may be connected to an upper end of the tubing hanger running tool 126, and the entire assembly of the tubing hanger 106, the tubing hanger running tool 126, and the sleeve 124 may be lifted as a single piece and inserted into the central bore 104 until the tubing hanger 106 lands on the load surface 108 of the wellhead 102.

The method 300 may then include actuating the ring 122 to the expanded configuration, as at 310. In embodiments, such as the illustrated embodiment, in which the ring 122 is biased radially outwards, this is accomplished by releasing the sleeve 124 from around the 122. To do this, the tubing hanger running tool 126 is rotated (or otherwise moved such that it translates) in a second direction relative to the tubing hanger 106, withdrawing the tubing hanger running tool 126 from the first bore 130. Such withdrawal applies an axially upward force onto the sleeve 124 through interaction between the shoulder 140 and the collar 142 (e.g., potentially via the upper bearing insert 150). The axially upward force lifts the sleeve 124 relative to the ring 122, permitting the ring 122 to expand into the expanded configuration and be received into the groove 162, thereby preventing upward vertical movement of the tubing hanger 106 relative to the wellhead 102, as discussed above.

In other embodiments in which the ring 122 is biased towards its collapsed configuration, the ring 122 may be driven outward by advancing the sleeve 124, such that the lower end 160 of the sleeve 124 is radially between the ring 122 and the tubing hanger 106. This may again be accomplished by rotating the tubing hanger running tool 126 so as to advance the tubing hanger running tool 126 into the first bore 130, e.g., rotating the tubing hanger running tool 126 in the first direction. This applies the axially downward force to the sleeve 124, and in such an embodiment, the taper 172 of the lower end 160 may be wedged between the tubing hanger 106 and the ring 122. In such an embodiment, a portion of the sleeve 124 may be detachable so as to remain radially between the ring 122 and the tubing hanger 106, so as to retain the ring 122 in the expanded configuration.

The method 300 may then include withdrawing the sleeve 124 and the tubing hanger running tool 126 from the tubing hanger 106, as at 312. This may be accomplished by rotating the tubing hanger running tool 126 in the second direction until the tubing hanger running tool 126 is fully withdrawn from the first bore 130. By connection with and lifting of the tubing hanger running tool 126, the sleeve 124 and the tubing hanger running tool 126 may then be lifted away from the wellhead 102, leaving the ring 122 and the tubing hanger 106 in the central bore 104.

Figure 4:
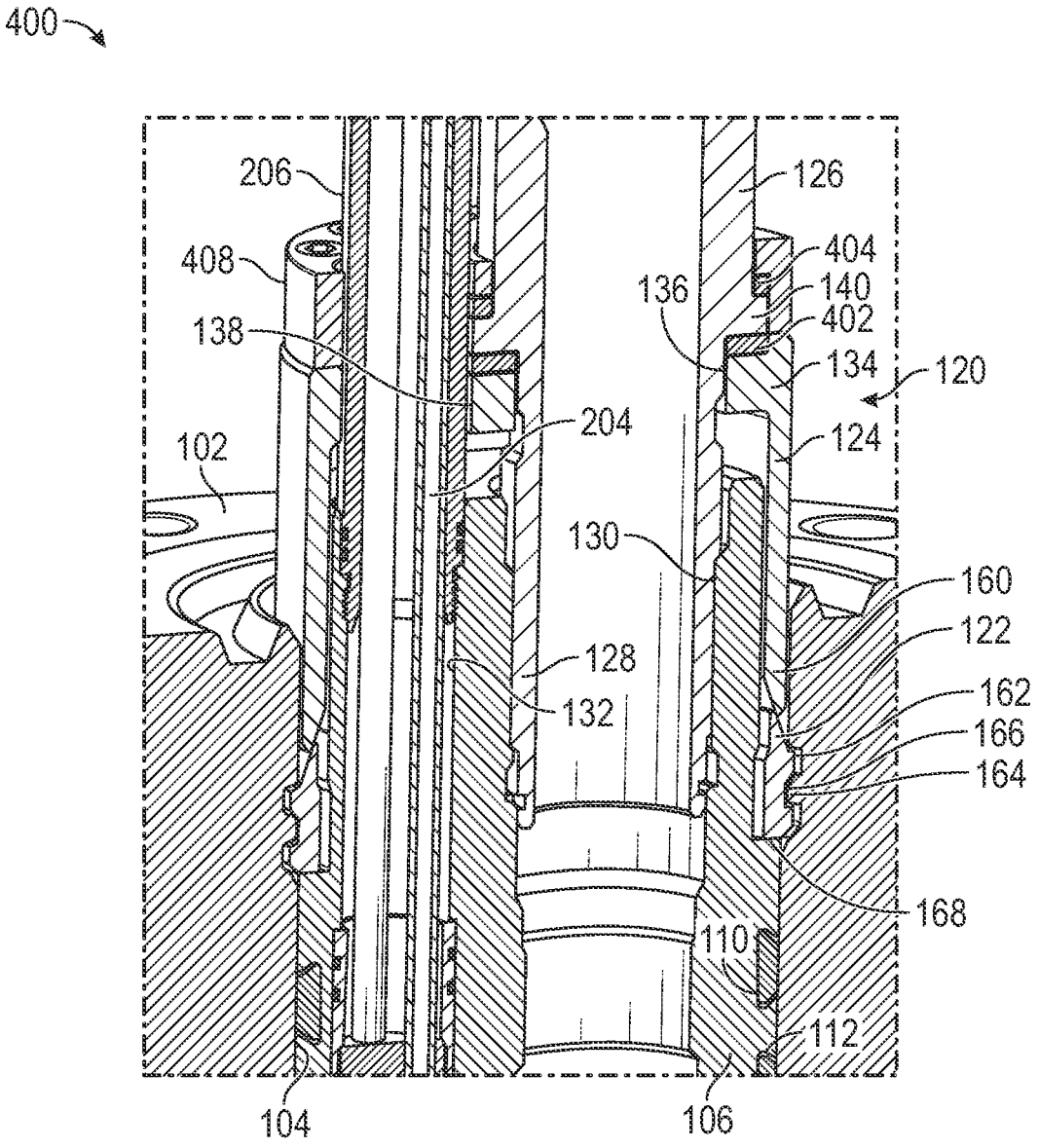
FIG. 4 illustrates a sectional view of part of another wellhead assembly, according to an embodiment.

FIG. 4 illustrates a sectional view of another wellhead assembly 400, according to an embodiment. The wellhead assembly 400 may be generally similar to the wellhead assembly 100 discussed above, and similar components are given the same numbers for purposes of convenience and to avoid a duplicative description thereof. The wellhead assembly 400 includes the sleeve 124, including the bearing plate 134, and the tubing hanger running tool 126, as discussed above.

A lower bearing insert 402 may be received on the bearing plate 134, and may surround the first bore 136, but may not surround the second bore 138. Similarly, an upper bearing insert 404 may be received around the tubing hanger running tool 126, and may be aligned with the first bore 136 and the lower bearing insert 402, but may not surround the second bore 138. In an embodiment, the lower and upper bearing inserts 402, 404 may be on opposite axial sides of the shoulder 140, thereby providing low-friction surfaces for transmission of axial forces during rotation of the tubing hanger running tool 126 relative to the sleeve 124, as discussed above.

Further, an upper cap 408 may be coupled to the upper end of the sleeve 124, so as to retain the inserts 402, 404. For example, the upper cap 408 may be recessed to accommodate the upper bearing insert 404, e.g., aligned with the bore 136, but may not be recessed in axial alignment with the bore 138, since the upper bearing insert 404 may not extend to that location. The upper cap 408 may be secured to the sleeve 124 using fasteners, for example, which may permit the disassembly of the upper cap 408 from the sleeve 124, and removal of the tubing hanger running tool 126 from the sleeve 124 as well as general disassembly of the other parts of the tubing hanger running tool assembly 120.

Figure 5:
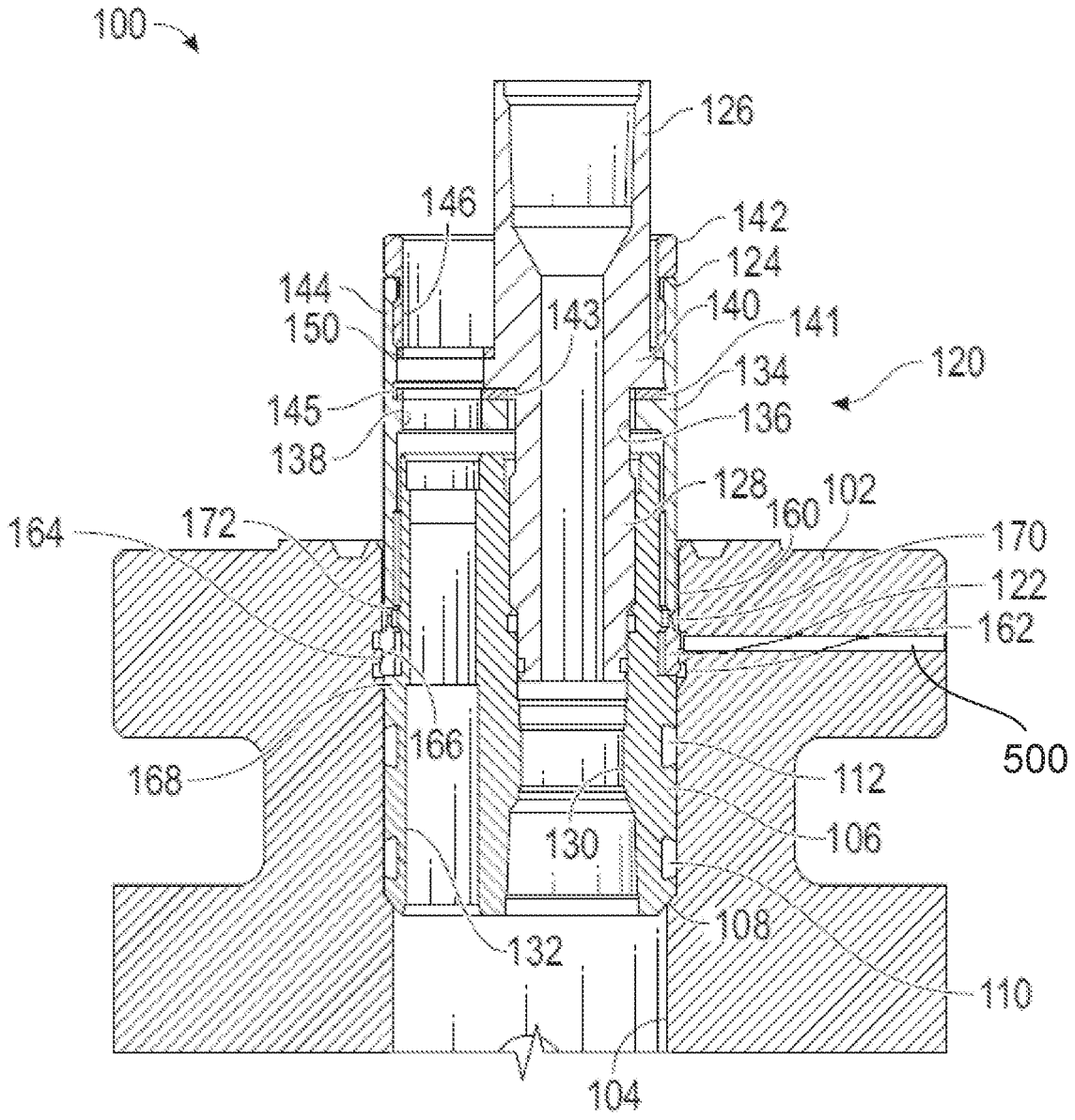
FIG. 5 illustrates a side, cross-sectional view of the wellhead assembly, including a proximity sensor, according to an embodiment.

FIG. 5 illustrates a cross-sectional view of the wellhead assembly 100, according to another embodiment. In this embodiment, the wellhead assembly 100 may additionally include a proximity sensor 500. The proximity sensor 500 may be received, for example, radially through the body of the wellhead 102. The proximity sensor 500 may thus be positioned in alignment with the groove 162, and may be configured to produce a signal that represents when the ring 122 is received into the groove 162. The proximity sensor 500 may be any type of sensor that is able to measure that the ring 122 has been received into the groove 162, such as a magnetic sensor, acoustic sensor, optical sensor, etc. In at least some embodiments, additionally or in lieu of a proximity sensor 500, the activation sleeve 124 may include a groove or another visual indicator, which may be aligned, e.g., with the top of the wellhead 102 when the ring 122 is received into the groove 162. Thus, the visual indicator may be precisely positioned to rapidly indicate to an operator that the tubing hanger 106 has landed in the wellhead 102.

Figure 6:
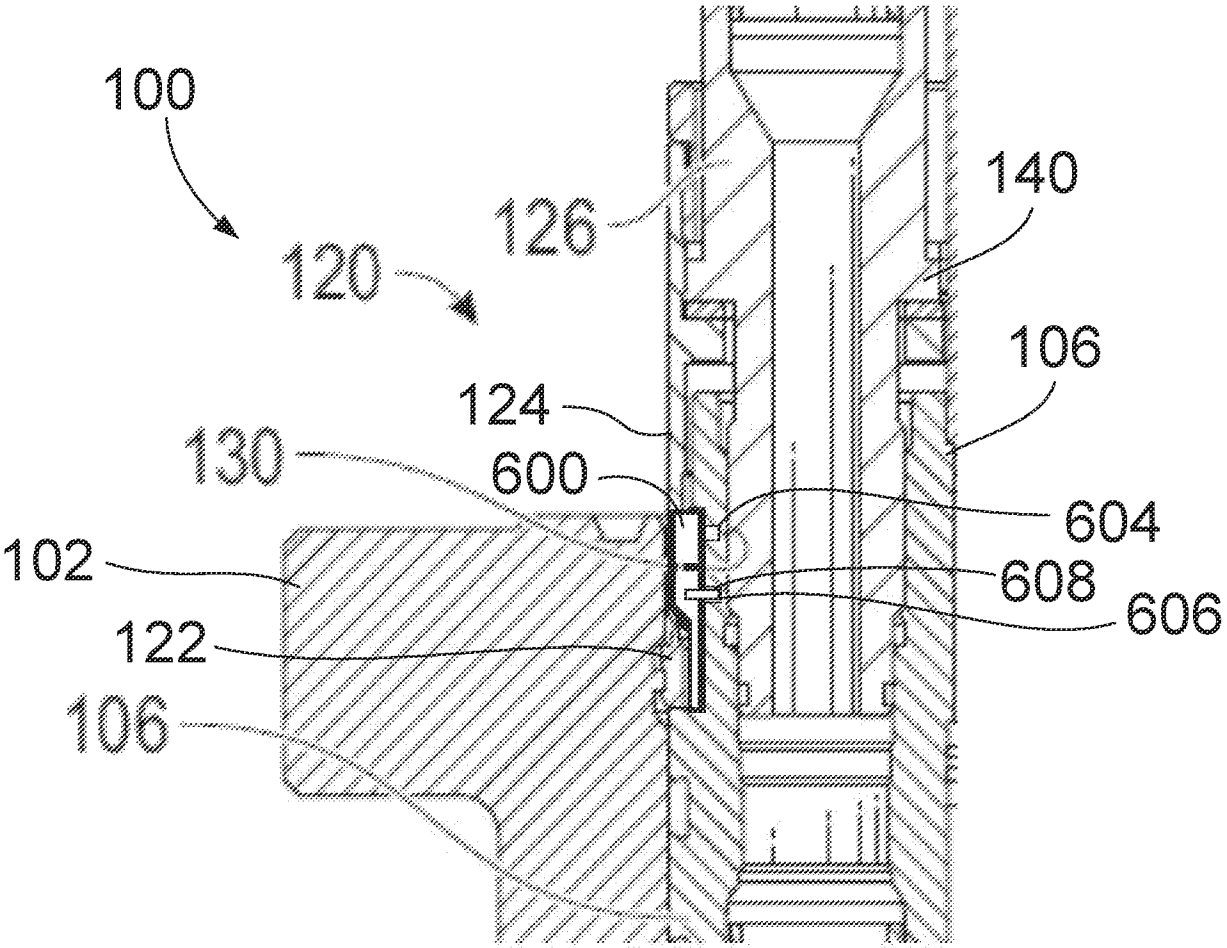
FIG. 6 illustrates a side, partial, cross-sectional view of the wellhead assembly, showing a indexing plate that engages the ring, according to an embodiment.

In at least some embodiments, the tubing hanger running tool 126 may press the ring 122 radially outward by vertical movement, e.g., instead of or in addition to rotation. FIG. 6 illustrates a partial, side, cross-sectional view of the wellhead assembly 100, according to another embodiment. In this embodiment, an indexing plate 600 is provided. A pin 608 is received in the indexing plate 600 and may be retractable. The tubing hanger 106 may provide two, axially-offset holes 604, 606, which may each be configured to receive the pin 608. The pin 608 may initially be received in the upper hole 604, e.g., during run-in. When the tubing hanger 106 lands in the wellhead 102, it may be prevented from further axial downward movement by an interaction between the tubing hanger 106 and the load surface 108 (e.g., FIG. 1A).

At this point, continued axial load on the tubing hanger running tool 126 may shift the sleeve 124 downward, pressing the pin 608 outward (e.g., through a tapered geometry) e.g., via the shoulder 140, which releases the indexing plate 600 and permits it to shift downwards. When the indexing plate 600 shifts downwards, it may press against the radial inside of the ring 122, causing the ring 122 to be received into the groove 162. The pin 608 may then align with the lower hole 606, e.g., at the same time that the tubing hanger running tool 126 lands on an interior load surface of the tubing hanger 106. The pin 608 may be biased outward, and thus upon reaching alignment, the pin 602 may extend into the hole 606 and prevent upward axial movement of the tubing hanger 106 relative to the wellhead 102. Accordingly, in at least some embodiments, instead of rotating the running tool 126, the tubing hanger 120 may use a jarring style tool or piston to push down on the sleeve 124, which translates the movement to the indexing (or "wedge") plate 600 downwards, thereby expanding the ring 122 into the groove 162.

In other embodiments, the pin 602 may be received into a J-slot, such that a sequence of axial and then circumferential, or circumferential and then axial, loading is employed to permit actuation of the indexing plate 600. In another embodiment, the pin 602 may shear under axial load, and then move axially into position, pressing the ring 122 radially outwards. In such case, friction forces or other structures may hold the ring 122 in position. Further, it will be appreciated that the indexing plate 600 may be readily implemented in embodiments in which the ring 122 is biased outwards, such that, axial and/or circumferential load applied to the plate 600 causes the plate 600 to move away from the ring 122, permitting the ring 122 to expand into the groove 162.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A tubing hanger running tool assembly, comprising:

a ring that is configured to extend around a tubing hanger in a wellhead, wherein the ring has a contracted configuration and an expanded configuration, the ring in the expanded configuration being configured to be received into at least one groove in the wellhead;

a sleeve configured to selectively engage the ring so as to actuate the ring between the contracted and expanded configuration;

a bearing plate defining a first bore that is configured to align with a first bore of the tubing hanger and a second bore that is configured to align with a second bore of the tubing hanger; and a tubing hanger running tool received through the sleeve and comprising a lower end that is configured to be received into the first bore of the tubing hanger, wherein the lower end is configured to form a connection with the first bore of the tubing hanger, wherein the tubing hanger running tool is configured to transmit an axial force to the sleeve in response to the tubing hanger running tool being received into the tubing hanger, wherein the axial force moves the sleeve axially with respect to the ring, and wherein moving the sleeve axially relative to the ring actuates the ring between the contracted and expanded configurations.

2. The tubing hanger running tool assembly of claim 1, further comprising an indexing plate coupled to the tubing hanger, wherein the indexing plate is movable responsive to axial translation of the sleeve from a first position relative to the tubing hanger to a second position relative to the tubing hanger, the indexing plate in the second position being configured to actuate the ring to the expanded configuration.

3. The tubing hanger running tool assembly of claim 1, further comprising a proximity sensor received through the wellhead and configured to provide a signal representing that the ring has been received into the groove.

4. The tubing hanger running tool assembly of claim 1, wherein the connection formed by the lower end of the tubing hanger running tool with the first bore of the tubing hanger is a threaded connection, and wherein the tubing hanger running tool is configured to transmit the axial force to the sleeve in response to the tubing hanger running tool being rotated relative to the tubing hanger.

5. The tubing hanger running tool assembly of claim 1, wherein the sleeve further comprises the bearing plate, and wherein the first and second bores of the bearing plate are eccentrically positioned with respect to a centerline of the bearing plate.

6. The tubing hanger running tool assembly of claim 5, wherein a wellhead electrical penetrator is received through the second bore of the bearing plate and the second bore of the tubing hanger, and wherein a production tubing is coupled to the first bore of the tubing hanger.

7. The tubing hanger running tool assembly of claim 5, wherein the tubing hanger running tool comprises a shoulder that transmits axial force to the sleeve, so as to move the sleeve upward or downward with respect to the ring.

8. The tubing hanger running tool assembly of claim 7, further comprising a first bearing insert positioned between the shoulder and the bearing plate of the sleeve, the first bearing insert being configured to transmit an axial downward force from the shoulder to the sleeve while permitting the tubing hanger running tool to rotate with respect to and while engaging the sleeve.

9. The tubing hanger running tool assembly of claim 8, wherein the first bearing insert comprises a first bore and a second bore, the first and second bores of the first bearing insert being aligned with the first and second bores, respectively, of the bearing plate.

10. The tubing hanger running tool assembly of claim 7, wherein the ring is biased toward the expanded configuration, and wherein a lower end of the sleeve retains the ring in the contracted configuration until the tubing hanger running tool is rotated and the sleeve is moved axially away from the ring.

11. The tubing hanger running tool assembly of claim 10, further comprising:

an upper collar coupled to an upper end of the sleeve, wherein rotating the tubing hanger running tool in a first direction relative to the tubing hanger causes the tubing hanger running tool to apply an axially upward force on the upper collar, which drives the sleeve upward, away from the ring, and wherein rotating the tubing hanger running tool in a second direction relative to the tubing hanger causes the tubing hanger running tool to apply an axially downward force on the bearing plate, which drives the sleeve downward, toward the ring; and an upper bearing insert positioned axially between the upper collar and the bearing plate, the tubing hanger running tool being received through the upper bearing insert, wherein the shoulder is configured to bear against the upper bearing insert so as to transmit the axially upward force thereto.

12. The tubing hanger running tool assembly of claim 1, wherein the ring is biased toward the contracted configuration, and wherein a lower end of the sleeve is configured to be received radially between the tubing hanger and the ring, such that rotating the tubing hanger running tool in a second direction presses the sleeve downward, and pressing the sleeve downwards forces the ring from the contracted configuration to the expanded configuration.

13. The tubing hanger running tool assembly of claim 1, wherein the ring comprises a split ring or a segmented ring that is either biased radially outward or radially inward.

14. A system, comprising:

a wellhead defining a central bore therein and a groove extending at least partially around the bore;

a tubing hanger received into the central bore of the wellhead, the tubing hanger defining a first bore and a second bore extending therethrough, the first bore for being connected to a production tubing;

a ring positioned around the tubing hanger and having a contracted configuration in which the ring does not prevent the tubing hanger from moving relative to the wellhead, and an expanded configuration in which the ring is received at least partially into the groove and is configured to prevent the tubing hanger from moving axially upwards with respect to the wellhead;

a tubing hanger running tool received into the first bore of the tubing hanger, wherein the tubing hanger comprises a threaded lower end that forms a threaded connection with the first bore;

a sleeve positioned around the tubing hanger running tool and the tubing hanger, wherein the sleeve is axially movable by rotating the tubing hanger running tool relative to the tubing hanger, and wherein the sleeve is configured to actuate the ring between the expanded and contracted configurations by moving axially with respect to the tubing hanger; and a bearing insert positioned below the sleeve and adjacent to a shoulder of the tubing hanger running tool, wherein the bearing insert defines a first bore that is configured to align with the first bore of the tubing hanger and a second bore that is configured to align with a second bore of the tubing hanger.

15. The system of claim 14, wherein the sleeve comprises a bearing plate therein having a first bore through which the tubing hanger running tool extends and a second bore, the tubing hanger running tool comprises a radially-extending shoulder that transmits a downward axial force to the bearing plate in response to the tubing hanger running tool rotating with respect to the tubing hanger, wherein the downward axial force moves the sleeve downward toward the ring.

16. The system of claim 15, wherein the sleeve comprises the bearing insert, which is interposed between the shoulder and the bearing plate.

17. The system of claim 15, further comprising an upper collar, wherein the bearing insert is interposed between the shoulder and the upper collar, such that rotating the tubing hanger running tool in a second direction applies an upward axial force to the sleeve via the bearing insert and the upper collar, so as to move the sleeve axially upward, away from the ring.

18. The system of claim 15, wherein the downward axial force presses a lower end of the sleeve radially between the tubing hanger and the ring, thereby actuating the ring from the contracted configuration to the expanded configuration.

19. The system of claim 15, wherein the upward axial force moves a lower end of the sleeve from radially between the ring and the wellhead, permitting the ring to resiliently expand into the expanded configuration.

20. The system of claim 15, wherein the tubing hanger running tool and the sleeve are removable from engagement with the tubing hanger by rotating the tubing hanger running tool out of connection with the tubing hanger, such that the tubing hanger running tool and the sleeve are removable from the wellhead without removing the tubing hanger.

21. The tubing hanger running tool assembly of claim 14, wherein the bearing insert is configured to permit rotation of the tubing hanger running tool relative to the sleeve.

22. A method, comprising:

receiving a tubing hanger running tool into a first bore of a tubing hanger and a sleeve around the tubing hanger, wherein the tubing hanger comprises a second bore, the first and second bores being eccentrically positioned in the tubing hanger;

aligning a bearing plate with the tubing hanger by:

aligning a first bore of the bearing plate with the first bore of the tubing hanger; and aligning a second bore of the bearing plate with the second bore of the tubing hanger;

actuating a ring positioned around the tubing hanger into an expanded configuration in which the ring engages a wellhead in which the tubing hanger is positioned, wherein actuating the ring comprises moving the tubing hanger running tool relative to the tubing hanger and the sleeve, wherein moving the tubing hanger running tool transmits an axial force to the sleeve, wherein the sleeve moves axially relative to the ring so as to actuate the ring, and wherein the ring in the expanded configuration prevents the tubing hanger from being displaced vertically upward in a wellhead; and withdrawing the tubing hanger running tool and at least a portion of the sleeve from engagement with the tubing hanger while the ring remains in the expanded configuration.

23. The method of claim 22, wherein moving the tubing hanger running tool relative to the tubing hanger and the sleeve comprises rotating the tubing hanger running tool relative to the tubing hanger and the sleeve.

24. The method of claim 22, wherein actuating the ring comprises wedging a lower end of the sleeve radially between the ring and the tubing hanger.

25. The method of claim 22, wherein actuating the ring comprises lifting a lower end of the sleeve out of engagement with the ring, such that the ring resiliently deflects outwards into engagement with a groove formed in the wellhead.

26. The method of claim 22, wherein actuating the ring comprises moving an indexing plate relative to the tubing hanger by translating the sleeve axially, without rotating the sleeve, such that the indexing plate presses the ring radially outwards.

27. The tubing hanger running tool assembly of claim 1, wherein the tubing hanger running tool is received through the first bore of the bearing plate.

* * * * *